US007095169B2

(12) United States Patent
Ohishi et al.

(10) Patent No.: US 7,095,169 B2
(45) Date of Patent: Aug. 22, 2006

(54) FLAT PANEL DISPLAY DEVICE

(75) Inventors: Tetsu Ohishi, Hiratsuka (JP); Masakazu Sagawa, Inagi (JP); Yoshie Kodera, Chigasaki (JP); Motoyuki Miyata, Hitachinaka (JP); Akinori Maeda, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 145 days.

(21) Appl. No.: 10/682,024

(22) Filed: Oct. 10, 2003

(65) Prior Publication Data

US 2004/0174114 A1 Sep. 9, 2004

(30) Foreign Application Priority Data

Mar. 3, 2003 (JP) ..... 2003-056008

(51) Int. Cl.
*H01J 63/04* (2006.01)

(52) U.S. Cl. ..... 313/495; 313/496; 313/497; 313/299

(58) Field of Classification Search ..... 313/293–304, 313/495–497, 422, 503
See application file for complete search history.

(56) References Cited

U.S. PATENT DOCUMENTS 3,855,499 A 12/1974 Yamada et al.
4,352,042 A 9/1982 Lorenz et al.
5,153,483 A 10/1992 Kishino et al.
5,477,105 A * 12/1995 Curtin et al. ..... 313/422
5,760,538 A * 6/1998 Mitsutake et al. ..... 313/422
5,990,614 A * 11/1999 Spindt ..... 313/495
6,333,600 B1 * 12/2001 Mizobata ..... 313/587
6,806,637 B1 10/2004 Uemura et al.
2002/0003399 A1 1/2002 Uemura et al.
2002/0011777 A1 * 1/2002 Konishi et al. ..... 313/495
2002/0079829 A1 * 6/2002 Ando et al. ..... 313/495
2003/0006696 A1 * 1/2003 Ito et al. ..... 313/496

* cited by examiner

*Primary Examiner*—Ashok Patel
*Assistant Examiner*—Anthony Canning
(74) *Attorney, Agent, or Firm*—Antonelli, Terry, Stout and Kraus, LLP.

(57) ABSTRACT

A flat panel display device capable of reducing charging of phosphors and disposing spacers easily and accurately. The flat panel display device has a rear substrate including an insulating substrate provided with many cold cathode elements for emitting electrons, a display substrate including a light-transmissive substrate disposed to face the rear substrate, and phosphors disposed on the light-transmissive substrate for generating light when excited by electron beams from the cold cathode elements, and a peripheral frame member. Provided on the light-transmissive substrate is a metal sheet perforated with plural fine holes arranged in a matrix configuration and having the phosphors disposed therewithin to form a light-emissive region.

20 Claims, 4 Drawing Sheets

FLAT PANEL DISPLAY DEVICE

BACKGROUND OF THE INVENTION

The present invention relates to a flat panel display device, and in particular to a field emission display (hereinafter FED), a flat panel display device incorporating in a hermetic container an electron source comprising a large number of cold cathode elements arranged in a matrix configuration for emitting electrons.

Known as electron emitting elements for use in FED are surface conduction type emission element (hereinafter SED type), field emission type (hereinafter FE type) and metal-insulator-metal type emission element (hereinafter MIM type). Among the FE type, there are the Spindt type made up chiefly of a metal such as Mo and a semiconductor material such as Si and the CNT (Carbon Nanotube) type using carbon nanotubes as its electron source. The SED type is disclosed in Japanese Patent Application Laid-Open No. 2000-164129, for example, and the MIM type is disclosed in Japanese Patent Application Laid-Open Nos. 2001-101965 and 2001-243901, for example.

As shown in FIG. 21 of Japanese Patent Application Laid-Open No. 2001-101965, for example, the FED type comprises: a rear substrate made of an insulating material and provided with an electron source composed of cold cathode elements serving as electron emission elements, arranged in a matrix configuration; and a display substrate made of a light-transmissive material, disposed to face the rear substrate, and provided with phosphors for emitting three primary colors of light, R, G, B when struck by electrons from the electron source. A peripheral frame is sandwiched between the rear and display substrates, and the rear and display substrates and the peripheral frame are sealed together as by a frit glass to complete a hermetic envelope, and then its interior is evacuated to a pressure in a range of from $10^{-5}$ to $10^{-7}$ torr.

In the FED, support members (hereinafter spacers) are provided between the rear and display substrates to prevent breakage of the hermetic envelope due to atmospheric pressure. Careful consideration is given to locations of the spacers so that they do not interfere with trajectories of electrons traveling from the electron emission elements toward the phosphors. Spacers can be located on a black matrix in the form of stripes disposed between the R, G and B phosphors, for example. An example of the arrangement of R, G and B phosphors and a black matrix is disclosed in Japanese Patent Application Laid-Open No. 2000-306510, for example.

Spacers for use in the FED are disclosed in SID 97 Digest (1997 Society for Information Display International Symposium Digest of Technical Papers Vol. 28, (1997)), pp. 52–55, for example. The flat panel display device reported in this paper has a 10-inch diagonal screen provided with 240×240×3 color-pixels (one pixel comprises a triad of R, G and B color-pixels), and is configured such that 28 spacers of 40×3×0.2 $mm^3$ are arranged. A spacing between the rear and display substrates is 3 mm, and a thickness and an aspect ratio of the spacers are 0.2 mm and 15, respectively. Vertical and horizontal pitches of color-pixels are 0.65 mm and 0.29 mm, respectively. The width of the spacers is greater compared with the pitches of the color-pixels even now. Japanese Patent Application Laid-Open No. 2000-294170 by one of the present inventors and others discloses a technique which provides the rear and display substrates with recesses conforming to the shape of spacers, and fits the spacers in the recesses, for the purpose of facilitating of attachment of the spacers.

SUMMARY OF THE INVENTION

In the FED, light is generated by phosphors struck by electrons from cold cathodes, and therefore a problem arises in that phosphors charged by charge accumulation suffer from degradation in light emission properties. Consequently, for preventing of the degradation in light emission properties of the phosphors it is necessary to reduce the charge accumulation on the phosphors.

Further, as disclosed in Japanese Patent Application Laid-Open No. 2001-101965, for example, a plurality of electron emission elements are arranged in a matrix configuration on the rear substrate, and bus interconnection layers are also formed on the rear substrate for interconnections between the respective electron emission elements. Consequently, it is difficult to secure spaces ranging across plural pixels for forming the above-mentioned recesses by avoiding the bus interconnection layers. Japanese Patent Application Laid-Open 2000-294170 does not consider this problem.

The present invention has been made in view of the above-described problem, and it is an object of the present invention to provide a flat panel display device capable of reducing charge accumulation on phosphors and locating spacers accurately and easily.

To accomplish the above object, the present invention is characterized by disposing a metal sheet perforated with plural holes (fine holes) arranged in a matrix configuration, on a light-transmissive substrate of a display substrate. Each of the holes has a phosphor disposed therewithin, and defines a light-emissive region, that is, a pixel.

Since the metal sheet is electrically conductive, charges accumulated on phosphors are led toward the metal sheet via wall surfaces of the fine holes in contact with the phosphors. Consequently, the configuration in accordance with the present invention is capable of reducing the charging of the phosphors, and thereby reducing the degradation in light emission properties of the phosphors.

In the above-mentioned display substrate, a low-melting-temperature glass layer may be used as an adherent layer for affixing the above-mentioned metal sheet to the light-transmissive substrate, and materials of the metal sheet, the light-transmissive substrate and the glass layer may be selected to be approximately equal in coefficient of thermal expansion to each other. This configuration can reduce influences of thermal deformation caused among the metal sheet, the light-transmissive substrate and the glass layer.

Further, it is preferable to blacken a light-transmissive-substrate-side surface of the metal sheet approximately black, and this makes it possible to use the black surface of the metal sheet as a black matrix and to assemble the support members accurately and easily without degrading contrast ratio. Blackening can be carried out by blackening the metal sheet fabricated from an Fe—Ni alloy, or by coating black pigments on the metal sheet.

Further, recesses may be formed in the metal sheet for holding the spacers therein. The recesses facilitate positioning of the spacers in fitting the spacers to the metal sheet. This makes it possible to position the spacers by inserting ends of the spacers into the recesses in the metal sheet, and thereby to assemble the spacers accurately and easily.

DETAILED DESCRIPTION OF THE PREFERRED EMBODIMENTS

The preferred embodiments in accordance with the present invention will be explained by reference to the drawings.

The following will explain examples of a flat panel display device of the present invention will be explained in detail by reference to FIGS. 1–5(*c*).

Figure 1:
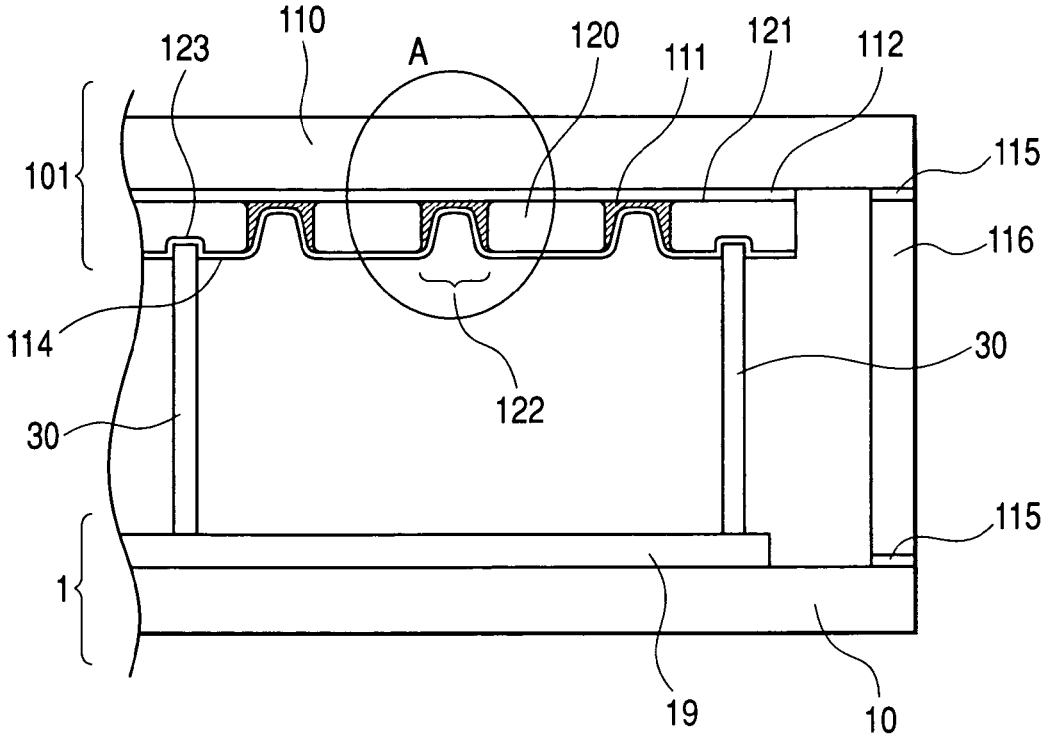
FIG. 1 illustrates a schematic configuration of a flat panel display device in accordance with an embodiment of the present invention.
Figure 2:
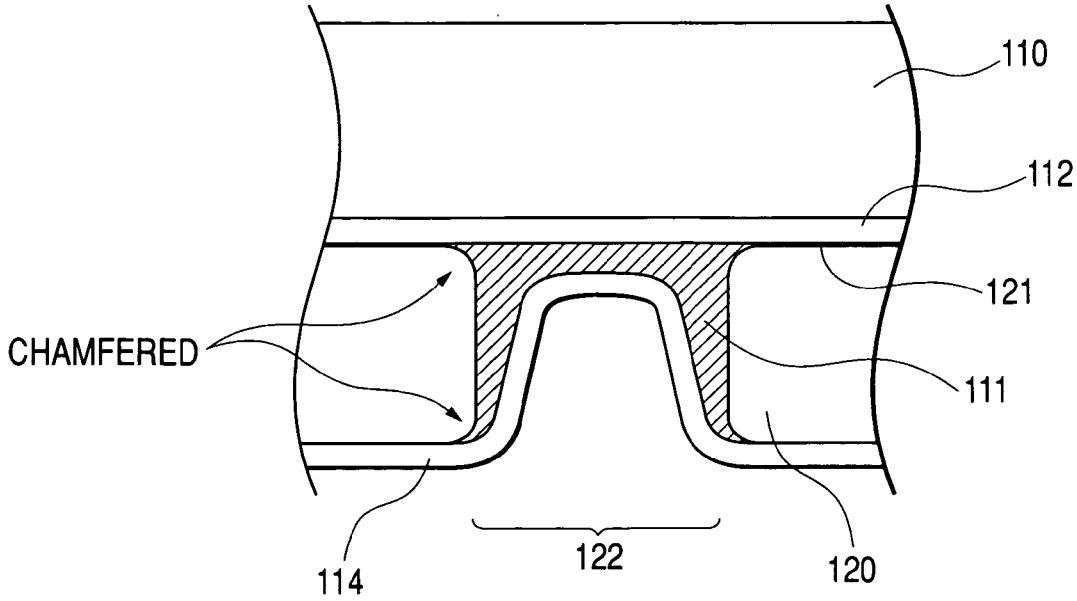
FIG. 2 is an enlarged detailed view of a portion designated A of FIG. 1.
Figure 3A:
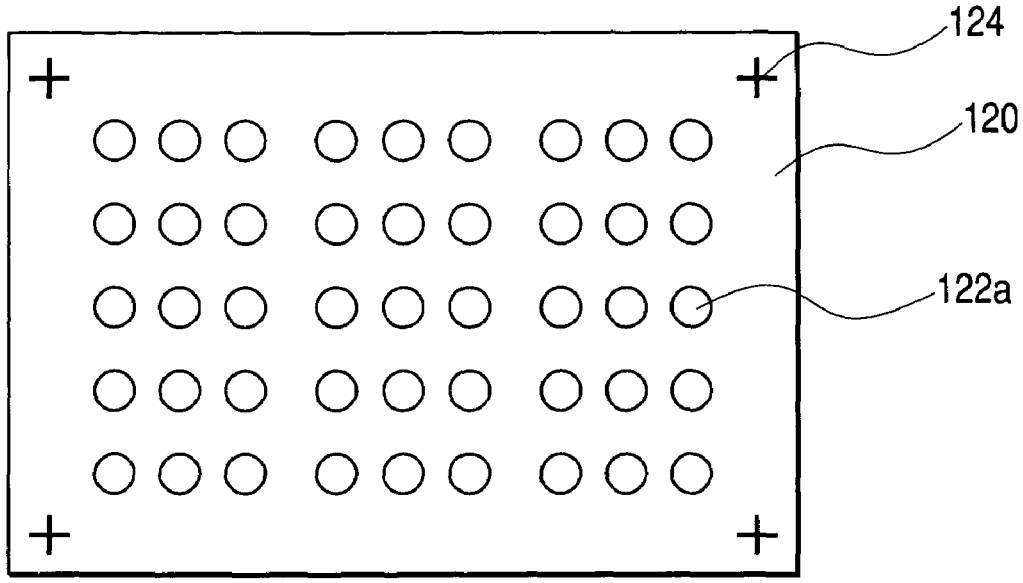
FIG. 3(*a*) is a top view of a metal sheet, and FIGS. 3(*b*)–3(*d*) are plan views of other examples of a shape of fine holes, respectively.
Figure 3B:
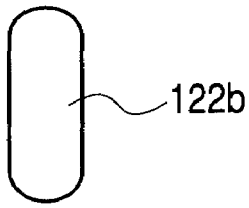
Figure 3C:
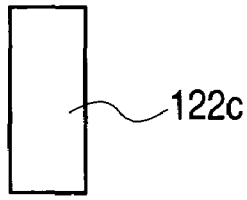
Figure 3D:
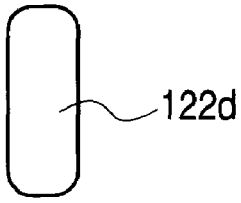
Figure 4A:
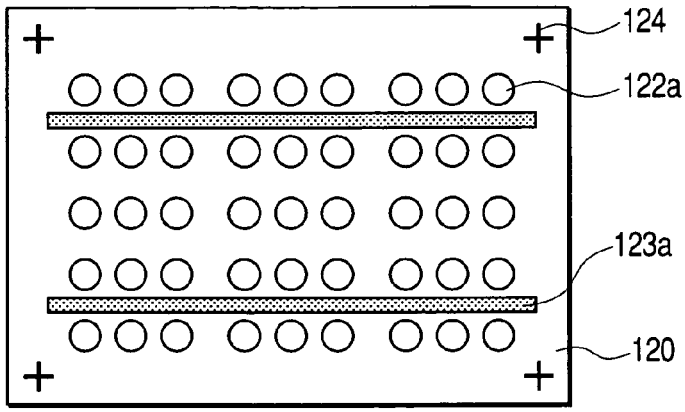
FIGS. 4(*a*)–4(*c*) illustrate two examples of a metal sheet provided with recesses, FIG. 4(*a*) is a top view of one of the two examples, FIG. 4(*b*) is a cross-sectional view of the metal sheet of FIG. 4(*a*)
FIG. 4(C) is a top view of the other of the two examples.
Figure 4B:
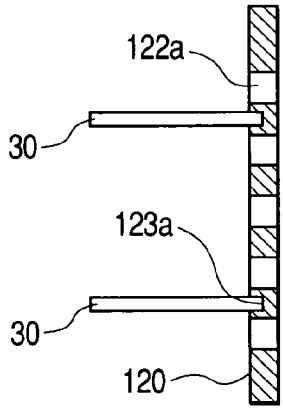
Figure 4C:
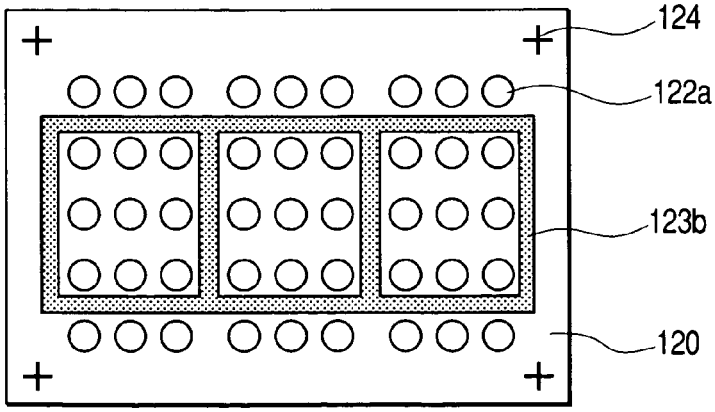
Figure 5A:
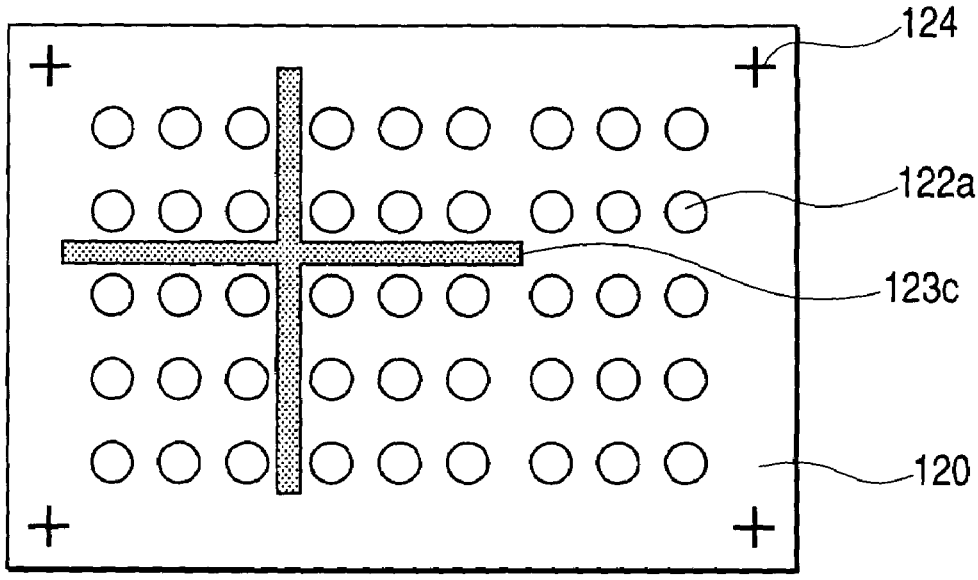
FIGS. 5(*a*) and 5(*b*) are top views of other two examples of a metal sheet provided with recesses, respectively.
Figure 5B:
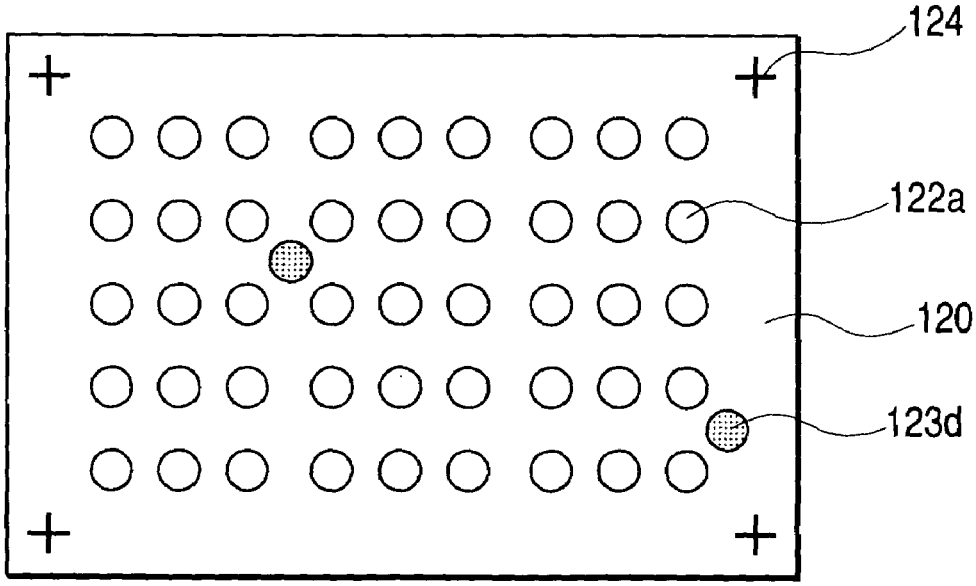

FIG. 1 illustrates a schematic configuration of a flat panel display device in accordance with an embodiment of the present invention. FIG. 2 is an enlarged detailed view of a portion designated A of FIG. 1. FIG. 3(*a*) is a top view of a metal sheet, and FIGS. 3(*b*)–3(*d*) are plan views of other examples of the shape of fine holes in the metal sheet, respectively. FIGS. 4(*a*)–4(*c*) illustrate examples of a metal sheet provided with recesses, FIG. 4(*a*) is a top view of one of the examples, FIG. 4(*b*) is a cross-sectional view of the metal sheet of FIG. 4(*a*), and FIG. 4(C) is a top view of the other examples of the two. FIGS. 5(*a*) and 5(*b*) are top views of other two examples of a metal sheet provided with recesses, respectively. The same reference numerals designate corresponding parts throughout the figures, and repetition of their explanations is omitted.

A flat panel display device to which the present invention is directed includes: a rear substrate made of an insulating material and provided with a large number of cold cathode elements for emitting electrons; and a display substrate made of a light-transmissive material, disposed to face the rear substrate, and provided with phosphors for emitting light when excited by electrons from the cold cathode elements; and a frame member. A space enclosed by the rear substrate, the display substrate and the frame member is evacuated to vacuum.

The display substrate includes a light-transmissive substrate on which is provided an electrically conductive sheet perforated with plural holes arranged in a matrix configuration. Each of the holes has a phosphor disposed therewithin, and defines a light-emitting region (a pixel). The holes are fine in diameter, and therefore they will be called fine holes hereinafter.

Further, in the following, the examples of the present invention will be explained by using a sheet made of metal as an example of the above-mentioned electrically conductive sheet, and therefore the electrically conductive sheet will be called the metal sheet hereinafter. However, any electrically conductive sheet has a function of attracting charges accumulated on phosphors disposed within the fine holes, and therefore it is needless to say that it is also within the scope of the present invention to use electrically conductive sheets other than metal sheets.

First, Embodiment 1 will be explained. FIG. 1 illustrates a schematic configuration of a flat panel display device in accordance with an embodiment of the present invention. In FIG. 1, a display substrate 101 includes a light-transmissive substrate 110 through which light is transmitted, such as a glass substrate, a thin metal sheet 120 perforated with a large number of fine holes 122 arranged in a matrix configuration (two-dimensionally), a low-melting-temperature adherent layer 112 for affixing the metal sheet 120 to the light-transmissive substrate 110, phosphors 111 coated and disposed within the fine holes 122 in the metal sheet 120, and a metal back 114 of aluminum (Al) formed on the metal sheet 120 by evaporation, for example.

The metal sheet 120 is perforated with a large number of fine holes 122 arranged in a matrix configuration as in the case of a shadow mask for use in a cathode ray tube (CRT), and the fine holes 122 are used to coat the phosphors 111 therewithin. The surface of the metal sheet 120 on its light-transmissive-substrate 110 side is used as a black matrix 121 by making the surface approximately black so as to prevent reflection of external light and thereby prevent degradation in contrast ratio. Further, formed at a number of position on the surface of the metal sheet 120 on its rear-substrate 1 side are recesses 123 in the form of pits or grooves receiving ends of spacers 30.

A rear substrate 1 includes an insulating substrate 10 made of glass or the like, for example, and an electron-emission-element-forming layer 19 of cold cathodes serving as electron sources, and formed of a large number of electron emission elements fabricated on the insulating substrate 10.

The flat panel display device is configured such that the display substrate 101 and the rear substrate 1 are supported by the spacers 30, they are sealed together at their peripheries with a peripheral frame 116 interposed therebetween by using a frit glass 115 to complete a hermetic envelope, and then its interior is evacuated to a pressure in a range of from $10^{-5}$ to $10^{-7}$ torr.

As described above, the metal sheet 120 is fabricated in a way similar to that for a shadow mask used as a color selection mask in a cathode ray tube (CRT) for color television. That is to say, the metal sheet 120 is fabricated as follows: A thin ultra-low-carbon steel sheet of an Fe—Ni system alloy is perforated with a large number of fine holes 122 arranged in a matrix configuration by using an etching method, then the surfaces of the steel sheet is subjected to a blackening treatment of heating at temperatures in a range of from 450° C. to 470° C. not exceeding the recrystallization temperature of the steel in an oxidizing atmosphere for 10–20 minutes. Therefore, the metal sheets can be fabricated by using conventional equipment for manufacturing shadow masks in its entirety.

The thickness of the metal sheet 120 is selected to be in a range of from 20 μm to 250 μm. The above lower limit to the sheet thickness is chosen because there is little commercial demand for steel sheets of 20 μm or less in thickness, and the sheet thickness is selected to be equal to or larger than the layer thickness of the phosphors 111, which is about 10 μm to about 20 μm as described subsequently. Since thin ultra-low-carbon steel sheets of the Fe—Ni system alloy are expensive, and it is preferable to select the metal sheet thickness to be 250 μm or less in view of little commercial demand for steel sheets of 250 μm or larger in thickness and the high cost.

The phosphors 111 disposed within the fine holes 122 are excited by electron beams from the electron emission elements on the rear substrate 1. There is the possibility that secondary electrons emitted from a given one of the phosphors 111 enter adjacent ones of the fine holes 122, and that the secondary electrons excite the phosphors 111 disposed within the adjacent fine holes 122 to luminescence. Here, if the depth of the fine holes 122, that is, the thickness of the metal sheet 120 is selected to be larger than that of the layers of the phosphors 111, the emitted secondary electrons are absorbed by the inner walls of the fine holes 122 (blackened oxide films of the inner walls are removed, and thereby are made electrically conductive, as explained in detail subsequently) and the metal back 114. Consequently, the above-mentioned secondary electrons can be prevented from entering the adjacent fine holes 122, and thereby the amount of charges accumulated on the phosphors can be reduced.

The surface of the metal sheet 120 is an insulating black oxide film formed by the blackening treatment, and therefore the surface of the metal sheet 120 on its light-transmissive-substrate 110 side can be used as the black matrix 121. However, the black oxide films on the inner walls of the fine holes 122 and on the surface of the metal sheet on its rear-substrate 1 side are removed by sandblasting, for example, for the purpose of eliminating charges accumulated on the phosphors, and providing an electrical contact with the metal back. This can impart electrical conductivity to the inner walls of the fine holes 122 in the metal sheet 120 and the surface of the metal sheet 120 on its rear-substrate 1 side.

The thus processed metal sheet 120 is affixed to the light-transmissive substrate 110 by using an adherent layer 112 made of material of a low-melting-temperature (50° C. or below). By way of example, a frit glass, a low-melting-temperature glass, is used as a material for the adherent layer 112. After coating the frit glass on the light-transmissive substrate 110, the metal sheet 120 is superimposed on the light-transmissive substrate 110, the adherent layer 112 is sintered by a heat treatment at temperatures of 450° C. to 470° C. Polysilazane, a liquid glass precursor, can also be used as another material for the adherent layer 112. The metal sheet 120 may be affixed to the light-transmissive substrate 110 by sintering this adherent layer at 120° C. or more.

The optical characteristic of the adherent layer is that the adherent layer does not always need to be transparent. For example, CRTs or the like have been using a glass with its light transmission reduced to a specified value as a material for their front panels, thereby to improve contrast ratio. Also in the present invention, while the light-transmissive substrate is selected to be transparent, the same advantage of improvement in contrast ratio as in the case of CRTs can be obtained by using as the adherent layer a glass layer having its light transmission reduced to a specified value. The light-transmission-reduced glass can be easily obtained by a conventional technique used for CRTs.

Since the metal sheet 120 is affixed to the light-transmissive substrate 110 with the adherent layer 112 interposed therebetween, it is desirable that the metal sheet 120 has approximately the same coefficient of thermal expansion as that of the light-transmissive substrate 110 to reduce thermal deformation caused by differences in thermal coefficients of expansion between the metal sheet 120 and the light-transmissive substrate 110. When the light-transmissive substrate 110 is made of glass, the coefficient of thermal expansion of the glass is in a range of from $38\times10^{-7}$ to $90\times10^{-7}$/° C. (at 30–300° C.), the coefficient of thermal expansion of the metal sheet 120 of an alloy made up chiefly of Fe—Ni can be made approximately equal to that of the light-transmissive substrate by adjusting the nickel (Ni) content of the metal sheet 120. For example, in a case where a borosilicate glass substrate having a coefficient of thermal expansion of $48\times10^{-7}$/° C. is used as the light-transmissive substrate 110, the coefficient of thermal expansion of the metal sheet 120 can be made approximately equal to that of the light-transmissive substrate 110 by using an Fe-42% Ni alloy for the metal sheet 120.

From the same point of view, it is desirable that the adherent layer also has approximately the same coefficient of thermal expansion as that of the light-transmissive substrate 110, and therefore, for example, as described above, used as the adherent layer is a frit glass having approximately the same coefficient of thermal expansion as that of the light-transmissive substrate made of glass.

It is desirable that the metal sheet 120 has approximately the same coefficient of thermal expansion as that of the light-transmissive substrate 110 for reducing thermal deformation. However, since the light-transmissive substrate and the adherent layer which are made of glass have poor resistance to tensile stress, the coefficient of thermal expansion of the metal sheet 120 may be selected to be slightly higher than those of the light-transmissive substrate 110 and the adherent layer 112 such that compressive stresses are applied to the light-transmissive substrate 110 and the adherent layer 112 during the actual use of the flat panel display device.

In the above-described example, the metal sheet perforated with a large number of fine holes in advance was subjected to the blackening treatment, and then was affixed to the light-transmissive substrate by using the adherent layer. However, the present invention is not limited to this process. For example, a metal sheet having its surface blackened in advance by being heated in an oxidizing atmosphere is affixed to the light-transmissive substrate by using the adherent layer, and then the metal sheet may be perforated with a large number of fine holes by using an etching technique. When this process is employed, the functions similar to those obtained by the previous example are not only obtained, but the efficiency of operation of affixing the metal sheet is also improved, because the fine holes are not present at the time when the metal sheet is affixed to the light-transmissive substrate, and therefore handling of the metal sheet is facilitated.

After the metal sheet 120 is affixed to the light-transmissive substrate 110 by using the adherent layer 112 made of glass as described above, red (R) phosphors, green (G) phosphors and blue (B) phosphors are coated in the thickness range of about 10 μm to about 20 μm within corresponding ones of the fine holes 122. Then, after application of filming on the phosphors, the metal back 114 made of aluminum, for example, is formed in the thickness range of from 30 nm to 200 nm by vacuum evaporation techniques. The metal back 114 eliminates charges accumulated on the phosphors 111, reflects light generated by the phosphors 111 toward the front surface, and is supplied with an accelerating voltage (an anode voltage) for accelerating electrons from the electron emission elements (That is to say, the metal back 114 serves as the accelerating electrode (the anode electrode)). It goes without saying that the metal back 114 needs to be sufficiently pervious to electrons from the electron emission elements. In view of this, the thickness of the metal back 114 is selected in the above thickness range, and it is preferably about 70 nm.

FIG. 2 is an enlarged detailed view of a portion designated A of FIG. 1. In the cross-sectional view of the fine hole 122 in the metal sheet 120 of FIG. 2, the corners of the wall surface of the fine hole 122 are rounded at the two surfaces on the light-transmissive-substrate 110 side and the rear-substrate 1 side opposite therefrom. This eliminates sharp corners, and thereby eliminates concentration of electric field to prevent electric breakdown. Further, as explained previously, the insulating black oxide films on the inner walls of the fine holes 122 in the metal sheet 120 and on the surface of the metal sheet 120 on its rear-substrate 1 side are removed by sandblasting, for example. Consequently, charges accumulated on the phosphors 111 and secondary electrons produced at the phosphors 111 move to the metal sheet 120 and the metal back 114, and thereby charging of the phosphors can be prevented.

Further, the thickness of the metal sheet 120 is selected to be 20 μm or more, thicker than that of the layer of the phosphors 111, and the inner walls of the fine holes 122 are formed with fine projections and indentations by sandblasting. Consequently, in coating the phosphors 111, these fine projections and indentations improve wettability of the phosphors, and therefore each of the phosphors 111 has a smoothly-curved generally-U-shaped cross-section (a bottom portion of about 100 μm in length and side portions of about 20 μm in length) when viewed from the light-transmissive-substrate 110 side. As a result, the metal back 114 of good quality is formed even within the fine holes 122, is less subject to peeling off, and has an improved contact with the phosphors 111.

FIG. 3(*a*) is a top view of the metal sheet 120. In FIG. 3(*a*), the metal sheet 120 is provided with a large number of fine holes 122 arranged in a matrix configuration (two-dimensionally). A pixel is formed by light generation by a phosphor coated and disposed within one of the fine holes 12. FIG. 3(*a*) illustrates a case where the fine holes are circular fine holes 122*a*. The phosphors are coated within the fine holes 122, and therefore the shape of the pixels conforms to that of the fine holes 122. The shape of the pixels, that is, the shape of the fine holes 122 is not limited to that of a circle, as in the case of cathode ray tubes, it may be oval as shown in FIG. 3(*b*), it may be rectangular as shown in FIG. 3(*c*), or may be the shape of a rectangle with its four corners rounded, that is, a rectangle with its four corners chamfered, as shown in FIG. 3(*d*). Incidentally, in FIG. 3(*a*), reference numeral 124 denote alignment marks to be explained in detail subsequently.

In the present invention, as shown in FIG. 1, the metal sheet 120 is provided with a plurality of recesses 123 disposed on its surface on a side opposite from its side facing the black matrix 121, and at positions where the recesses 123 do not interfere with the fine holes 122. The recesses 123 are overlapped on the black matrix 121 when viewed from the light-transmissive-substrate 110 side, and therefore there is no concern that the spacers 30 fitted in the recesses 123 have adverse effects on trajectories of electron beams traveling from the rear substrate 1 to the phosphors 111. In the present invention, the depth of the recesses 123 is selected to be in a range of from 10 μm to 125 μm, which is approximately half the thickness of the metal sheet 120.

FIGS. 4(*a*), 4(*c*), 5(*a*) and 5(*b*) are top views of four examples of the metal sheet 120 formed with recesses disposed to oppose a region of the black matrix lying between the circular fine holes (which correspond to pixels) shown in FIG. 3(*a*) for the purpose of fitting spacers 30 in the recesses, respectively. Here, in order to simplify the figures, the screen is represented as having 5 lines ×3 pixels (one pixel comprises a trio of R-light-emitting, G-light-emitting and B-light-emitting color-pixels). However, it is needless to say that, in an actual flat display device, a larger number of recesses 123 are provided disposed over the entire area of the metal sheet for disposing a sufficient number of spacers for withstanding atmospheric pressure.

In FIGS. 4(*a*), 4(*c*), 5(*a*) and 5(*b*), the recesses 123 (123*a*, 123*b*, 123*c* and 123*d*) are configured for the spacers 30 to be fitted in for facilitating of assembling of the spacers 30. The positioning accuracy of the spacers 30 depends upon the fabrication accuracy of the recesses 123. Since the recesses can be fabricated by using etching techniques as in the case of the fine holes, they can be formed accurately. Consequently, the spacers 30 can be positioned at the specified positions accurately with respect to the rear substrate 1. Alignment marks 124 in the form of a cross, for example, are etched into the four corners of the metal sheet 120 as in the case of the fine holes 122. In general, the cost of assembling of the spacers 30 is made lower by automation of the assembling using a micromachine, for example. However, this example provides an advantage that automatic positioning of the spacers 30 can be carried out by using the alignment marks 124 as positioning markers. In this example, the alignment marks 124 are disposed at the four corners, but the present invention is not limited to this arrangement. It is needless to say that, by way of example, the alignment marks 124 may be disposed at ends of a diagonal of the metal sheet 120. Further, it is needless to say that the shape of the recesses 123 is similar to that of ends of the spacer 30 to be fitted in the recesses 123.

FIG. 4(*a*) illustrates an example of the recesses used for disposing plate-like spacers each extending horizontally in FIG. 4(*a*). Two long and narrow rectangular recesses 123*a* are disposed to extend horizontally in FIG. 4(*a*) for disposing the plate-like spacers 30. Plural spacers are necessary for the flat panel display device to withstand atmospheric pressure applied thereon, and therefore the recesses 123*a* for fitting the spacers therein are also plural in number. It is needless to say that the recesses may be disposed to extend vertically instead in FIG. 4(*a*).

FIG. 4(*c*) illustrates a recess 123*b* in the form of a ladder. The spacers (not shown) corresponding to this recess 123*b*comprises two first-type plate-like spacers mutually opposing and parallel with each other and four (by way of example only and not limited to this number) second-type spacers parallel with each other and joined between the two first-type plate-like spacers. That is to say, the first- and second-type plate-like spacers are affixed to be perpendicular to each other to form a spacer in the form of a ladder. Such a ladder-shaped spacer provides a stronger support strength compared with that of the spacers shown in FIG. 4(*a*).

In an example illustrated in FIG. 5(*a*), a recess 123*c*is provided in the form of a cross comprising two recesses extending in vertical and horizontal directions, respectively, in FIG. 5(*a*). The spacer (not shown) corresponding to this recess 123*c* is a combination of two plate-like spacers arranged perpendicularly to each other to form the shape of a cross. In FIG. 5(*a*), the cross-shaped recess 123*c* is disposed in only one portion of the metal sheet 120. However, it is needless to say that, in actual embodiments of the present invention, provided over an entire area of the metal sheet 120 are a large number of the cross-shaped recesses 123*c* for disposing a sufficient number of spacers for withstanding atmospheric pressure.

In an example illustrated in FIG. 5(*b*), circular recesses 123*d* are provided for disposing column-shaped spacers (not shown). It is needless to say that, in FIG. 5(*b*), horizontally elliptical or vertically elliptical spacers (not shown) may be used instead of the column-shaped spacers (not shown). In this case, the recesses are elliptical. Further, the spacers may be of the shape of a square pillar or a square pillar with its four corners chamfered, and in this case the recesses are made rectangular or rectangular with their four corners rounded.

As described above, the present invention employs the thin metal sheet perforated with a large number of fine holes, and have the phosphors coated within the fine holes. Further, the present invention uses one surface of the metal sheet having a black oxide film formed thereon as a black matrix for improving contrast ratio, and disposes the spacers by fitting them in the plural recesses formed in the other surface of the metal sheet opposing the one surface of the metal sheet. This configuration makes it possible to assemble the spacers accurately and easily without degrading contrast ratio.

In the above-described embodiments of the present invention, the ultra-low carbon steel sheet of the Fe—Ni system alloy is used as the metal sheet 120, and the metal sheet 120 subjected to a blackening treatment in advance is affixed to the light-transmissive substrate 110 by coating the adherent member on the light-transmissive substrate 110. However, the present invention is not limited to this configuration. By way of example, without applying the blackening treatment to the metal sheet 120, an adherent material blackened by mixing black pigments therein is coated on the metal sheet 120, and then the metal sheet 120 may be affixed to the light-transmissive substrate 110 by using the blackened adherent material. That is to say, a heat-resistant adhesive made chiefly of glasses, ceramics or alumina, and containing black pigments is printed, clearing the fine holes 122 on the metal sheet 120 having no blackening treatment applied thereto, and then the metal sheet 120 is affixed to the light-transmissive substrate 110 via the heat-resistant adhesive, and simultaneously with this, the black matrix 121 is fabricated. With this configuration, the blackening treatment of the metal sheet is not necessary, and therefore the process step of sandblasting can be omitted which removes the black oxide films from the inner walls of the fine holes 122 and the surface of the metal sheet to be coated with the metal back. However, if some of the adhesive protrudes from the fine holes, it needs to be removed as by sandblasting. Since the metal sheet perforated with the fine holes are thin and perforated, there is a possibility that the metal sheet bends by force of gravity during its handling. To eliminate this problem, initially an imperforate metal sheet is affixed to the light-transmissive substrate by using the above-described heat-resistant adhesive, and thereafter the metal sheet is perforated with fine holes arranged in a matrix configuration by using etching techniques. This processing step prevents the metal sheet from bending due to handling during the operation of affixing the metal sheet to the light-transmissive substrate. However, the adhesive needs to be removed as by etching or sandblasting after formation of the fine holes.

As explained above, the present invention provides a flat panel display device capable of reducing charges accumulated on the phosphors, and making it possible to dispose spacers easily and accurately.

What is claimed is:

1. A flat panel display device comprising:

a rear substrate including an insulating substrate and a plurality of cold cathode elements disposed on said insulating substrate for emitting electrons;

a display substrate including a light-transmissive substrate disposed to face said rear substrate and phosphors disposed on said light-transmissive substrate for generating light when excited by electron beams from said plurality of cold cathode element;

a peripheral frame member interposed between said rear substrate and said display substrate such that a space enclosed by said peripheral frame member, said rear substrate and said display substrate is vacuum tight;

a metal sheet provided on a surface of said light-transmissive substrate facing toward said rear substrate and perforated with a plurality of holes each corresponding to one of said plurality of cold cathode elements; and a metal back adapted to be supplied with an anode voltage for leading said electrons from said plurality of cold cathode elements toward said metal sheet;

wherein each of said plurality of holes has a corresponding one of said phosphors disposed therewithin, and a thickness of said metal sheet is greater than a thickness of said phosphors disposed within said plurality of holes; and wherein said display substrate further includes an adherent layer for affixing said metal sheet to said light-transmissive substrate.

2. A flat panel display device according to claim 1, wherein said metal sheet is perforated with said plurality of holes after said metal sheet is affixed to said light-transmissive substrate with an adherent layer.

3. A flat panel display device according to claim 1, wherein said adherent layer is made chiefly of one of glass, ceramics and alumina.

4. A flat panel display device according to claim 3, wherein said adherent layer is a layer having its light transmission limited to a specified value, and made chiefly of one of a glass, ceramics and alumina.

5. A flat panel display device according to claim 1, wherein coefficients of thermal expansion of said metal sheet, said light-transmissive substrate and said adherent layer are approximately equal to one another.

6. A flat panel display device according to claim 1, wherein said metal sheet has a uniform thickness in a range of from 20 μm to 250 μm.

7. A flat panel display device according to claim 1, wherein said metal sheet is made of an alloy made chiefly of Fe—Ni.

8. A flat panel display device according to claim 1, wherein a cross-sectional shape of said holes is rounded.

9. A flat panel display device according to claim 1, wherein a surface of said metal sheet facing toward said light-transmissive substrate is approximately black.

10. A flat panel display device according to claim 1, wherein inner walls of said plurality of holes are electrically conductive.

11. A flat panel display device according to claim 1, wherein a cross-sectional shape of said phosphors is generally U-shaped.

12. A flat panel display device according to claim 1, wherein said metal sheet is provided on a side thereof facing toward said rear substrate with said metal back.

13. A flat panel display device according to claim 1, wherein said flat panel display device further comprises spacers for maintaining a spacing between said rear substrate and said display substrate, and said metal sheet is provided with recesses for holding said spacers.

14. A display device comprising:

a rear substrate provided with a plurality of cold cathode elements for emitting electrons;

a display substrate including a light-transmissive substrate disposed to face said rear substrate;

an electrically conductive sheet provided on a surface of said light-transmissive substrate facing toward said rear substrate, and a metal back adapted to be supplied with an anode voltage for leading said electrons from said plurality of cold cathode elements toward said electrically conductive sheet, said metal back being provided on a side of said electrically conductive sheet facing toward said rear substrate;

wherein said electrically conductive sheet is perforated with a plurality of holes each corresponding to one of said plurality of cold cathode elements, each of said plurality of holes has a phosphor disposed therewithin for generating light when excited by said electrons emitted from said plurality of cold cathode elements, and a thickness of said electrically conductive sheet being greater than a thickness of said phosphors disposed within said plurality of holes; and wherein said display substrate further includes an adherent layer for affixing said electrically conductive sheet to said light-transmissive substrate.

15. A display device comprising;

a rear substrate provided with a plurality of cold cathode elements for emitting electrons;

a display substrate including a light-transmissive substrate disposed to face said rear substrate;

a black sheet provided on a surface of said light-transmissive substrate facing toward said rear substrate; and a metal back adapted to be supplied with an anode voltage for leading said electrons from said plurality of cold cathode elements toward said black sheet;

wherein said black sheet is perforated with a plurality of holes each corresponding to one of said plurality of cold cathode elements, each of said plurality of holes having a phosphor disposed therewithin for generating light when excited by said electrons emitted from said plurality of cold cathode elements, and a thickness of said black sheet is greater than a thickness of said phosphor disposed within said plurality of holes; and wherein said display substrate further includes an adherent layer for affixing said black sheet to said light-transmissive substrate.

16. A flat panel display device according to claim 15, wherein said black sheet is electrically conductive, and said metal back is provided on a side of said black sheet facing toward said rear substrate.

17. A flat panel display device according to claim 15, wherein said black sheet is made of a metal.

18. A flat panel display device comprising:

a rear substrate provided with a plurality of cold cathode elements for emitting electrons;

a display substrate including a light-transmissive substrate disposed to face said rear substrate;

spacers interposed between said rear substrate and said display substrate for maintaining a spacing therebetween; and an electrically conductive sheet provided on a surface of said light-transmissive substrate facing toward said rear substrate, and a metal back adapted to be supplied with an anode voltage for leading said electrons from said plurality of cold cathode elements toward said electrically conductive sheet;

wherein said electrically conductive sheet is perforated with a plurality of holes each corresponding to one of said plurality of cold cathode elements, each of said plurality of holes having a phosphor disposed therewithin for generating light when excited by said electrons emitted from said plurality of cold cathode elements, said electrically conductive sheet is provided with recesses for holding said spacers, at positions of said electrically conductive sheet which do not interfere with said plurality of holes, and a thickness of said electrically conductive sheet is greater than a thickness of said phosphor disposed within said plurality of holes.

19. A flat panel display device according to claim 18, wherein said electrically conductive sheet is a metal sheet.

20. A flat panel display device according to claim 18, wherein said electrically conductive sheet is a black sheet.

* * * * *